US007617993B2

(12) United States Patent
Srinivasan et al.

(10) Patent No.: US 7,617,993 B2
(45) Date of Patent: Nov. 17, 2009

(54) DEVICES AND METHODS FOR ATOMIZING FLUIDS

(75) Inventors: Vedanth Srinivasan, Farmington Hills, MI (US); Abraham J. Salazar, Lexington, KY (US); Kozo Saito, Lexington, KY (US); Richard Alloo, Lexington, KY (US); Masahito Sakakibara, Okazaki (JP)

(73) Assignees: Toyota Motor Corporation, Toyota, Aichi Prefecture (JP); University of Kentucky, Lexington, KY (US); Toyota Motor Engineering and Manufacturing North America, Inc., Erlanger, KY (US)

( * ) Notice: Subject to any disclaimer, the term of this patent is extended or adjusted under 35 U.S.C. 154(b) by 71 days.

(21) Appl. No.: 11/947,258

(22) Filed: Nov. 29, 2007

(65) Prior Publication Data

US 2009/0140067 A1 Jun. 4, 2009

(51) Int. Cl.
*B05B 3/04* (2006.01)
*B05B 17/04* (2006.01)

(52) U.S. Cl. ..... 239/102.2; 239/102.1; 239/499; 239/4; 239/590.5; 239/590

(58) Field of Classification Search ..... 239/4, 239/102.1, 102.2, 590, 590.5
See application file for complete search history.

(56) References Cited

U.S. PATENT DOCUMENTS 3,145,931 A 8/1964 Cleall
3,373,752 A 3/1968 Inoue
3,474,967 A 10/1969 Bodine
3,528,704 A * 9/1970 Johnson, Jr. ..... 299/14
4,138,687 A 2/1979 Cha et al.
4,262,757 A * 4/1981 Johnson et al. ..... 175/67
4,465,234 A 8/1984 Maehara et al.
4,541,564 A 9/1985 Berger et al.
4,605,167 A 8/1986 Machara
4,635,849 A 1/1987 Igashira et al.
4,726,522 A * 2/1988 Kokubo et al. ..... 239/102.2
4,726,523 A * 2/1988 Kokubo et al. ..... 239/102.2
4,726,524 A * 2/1988 Ishikawa et al. ..... 239/102.2
5,154,347 A * 10/1992 Vijay ..... 239/4
5,248,087 A 9/1993 Dressler
5,685,485 A 11/1997 Mock et al.

(Continued)

OTHER PUBLICATIONS

Geschner, F., Chaves, H., Obermeier, F., "Investigation of Different Phenomena of the Disintegration of a Sinusoidally Forced Liquid Jet," ILASS-Europe 2001, Zurich Sep. 2-6, 2001.

(Continued)

*Primary Examiner*—Len Tran
*Assistant Examiner*—James S Hogan
(74) *Attorney, Agent, or Firm*—Dinsmore & Shohl LLP

(57) ABSTRACT

One embodiment of the invention is directed to an apparatus for atomizing a fluid. This apparatus includes an atomizing nozzle assembly. The atomizing nozzle assembly includes: a spray applicator enclosure having a fluid entry zone, a flow shape profiler region, a transducer, and a cavitation enhancer module, wherein the cavitation enhancer module includes a residence modulation zone and the residence modulation zone includes a backward facing step region. The apparatus is configured such that fluid can enter the fluid entry zone to the nozzle profiler, the transducer and the cavitation enhancer module. Other embodiments relate to methods for atomizing fluids.

18 Claims, 2 Drawing Sheets

U.S. PATENT DOCUMENTS

| | | | | |
|---|---|---|---|---|
| 6,659,365 | B2 * | 12/2003 | Gipson et al. | 239/102.2 |
| 6,789,743 | B2 | 9/2004 | Baranowski et al. | |
| 2005/0145474 | A1 | 7/2005 | Lemme et al. | |
| 2006/0131447 | A1 | 6/2006 | Masuda et al. | |
| 2007/0040043 | A1 | 2/2007 | Onozawa | |

OTHER PUBLICATIONS

Chung, I-ping, Presser, C., Dressler J.L., "Effect of Piezoelectric Transducer Modulation on Liquid Sheet Disintegration," Atomization and Sprays, vol. 8, pp. 479-502, 1998.

Reitz, R.D., "Atomization and Other Breakup Regimes of a Liquid Jet," Ph.D. thesis, Princeton University, Princeton, NJ. 231 pp, 1978.

McCormack et al., "An Experimental and Theroetical Analysis of Cylindrical Liquid Jets Subjected to Vibration," Brit. J. Appl. Phys, vol. 16, pp. 395-409, 1965.

Crane et al., "The Effect of Mechanical Vibration on the Break-Up of a Cylindrical Water Jet in Air," Brit. J. Appl. Phys., vol. 15, pp. 743-751, 1964.

Dunne et al., "Velocity Discontinuity Instability of a Liquid Jet," Journal of Applied Physics, vol. 27, No. 6, pp. 577-582, Jun. 1956.

Chung et al., "Characterization of a Spray From an Ultrasonically Modulated Nozzle," Atomization and Sprays, vol. 7, pp. 295-315, 1997.

Srinivasan et al., "A Numerical Study of a New Spray Applicator," A dissertation submitted in partial fulfillment of the requirements for the degree of Doctor of Philosophy in the College of Engineering at the University of Kentucky, 2006.

International Search Report and Written Opinion dated Jan. 28, 2009 pertaining to International application No. PCT/US2008/084862.

* cited by examiner

DEVICES AND METHODS FOR ATOMIZING FLUIDS

TECHNICAL FIELD

The present invention is directed to devices and methods for atomizing fluids.

BACKGROUND

The generation of a fine droplet size distribution of fluids is desirable to many application such as spray combustion, spray painting, spray drying, etc. Typically, atomization processes are used to generate the small droplet size distribution necessary for such applications. Generally, the better the size distribution of these apparatus, the more improved the efficiency of the operating system.

To realize and improve fine particle size distribution, current efforts focus on changes in the nozzle and fluid delivery designs. Today, many of the conventional nozzle designs operate based on only a few of the distinct parameters identified to influence the break-up effect, such as, pressure effects.

Forced modulation of fluid jets within the nozzles result in the generation of a wide morphology of fluid structures. With increase in the modulation amplitude, breakup lengths are reduced appreciably. Some previous designs have used forced fluid jet concepts for obtaining (1) uniform size droplets in a reproducible fashion and (2) for obtaining cavitating interrupted jets. Other devices use low modulation effects for low flow rate applications to generate mono-size droplet distribution. In addition, other devices use high frequency oscillations on fluid jets to help obtain fine droplet sizes. However, frequency effects sometimes dominate the droplet production due to capillary mechanisms, a consequence of small time scale process, leading to low velocity sprays. Thus, previous systems resulted in restricted fluid flow rates and low velocity spray. As such, new devices and methods for atomizing fluids are needed.

SUMMARY

One embodiment of the invention is directed to an apparatus for atomizing a fluid. This apparatus includes an atomizing nozzle assembly. The atomizing nozzle assembly includes: a spray applicator enclosure having a fluid entry zone, a flow shape profiler region, a transducer, and a cavitation enhancer module. The cavitation enhancer module includes a residence modulation zone and the residence modulation zone includes a backward facing step region. The apparatus is configured such that fluid can enter the fluid entry zone to the nozzle profiler, the transducer and the cavitation enhancer module.

According to another embodiment, the invention is directed to a method for atomizing a fluid. The method includes: receiving pressurized fluid flow through a fluid entry zone in an atomizing apparatus. The atomizing apparatus includes a spray applicator enclosure having the fluid entry zone, a flow shape profiler region, a transducer, and a cavitation enhancer module. The cavitation enhancer module includes a residence modulation zone and the residence modulation zone includes a backward facing step region. The method further includes allowing the fluid to flow axially towards the flow shape profiler region; performing oscillatory motion across the fluid in an axial fashion parallel to the nozzle axis and shearing the fluid as it enters the backward facing step region of the residence modulation zone.

According to another embodiment, the invention is directed to a method for atomizing a fluid. The method includes: receiving a pressurized fluid flow in an apparatus; accelerating the fluid through a nozzle in the apparatus; performing ultrasonic oscillation on the fluid in a direction parallel to the nozzle axis to create regions of low pressure down stream of the nozzle to cause pressure pulsation and modulate the flow with activated cavitation nuclei; imparting a shearing action on the modulated flow to enhance cavitation; creating a low pressure region to increase residence time for cavitation; impinging the fluid on a wall to increase static pressure and cause local cavitation collapse effect; and accelerating the collapsed cavitation flow toward an exit of the apparatus.

Additional embodiments, objects and advantages of the invention will become more fully apparent in the detailed description below.

BRIEF DESCRIPTION OF THE DRAWINGS

The following detailed description will be more fully understood in view of the drawings in which.

Figure 1:
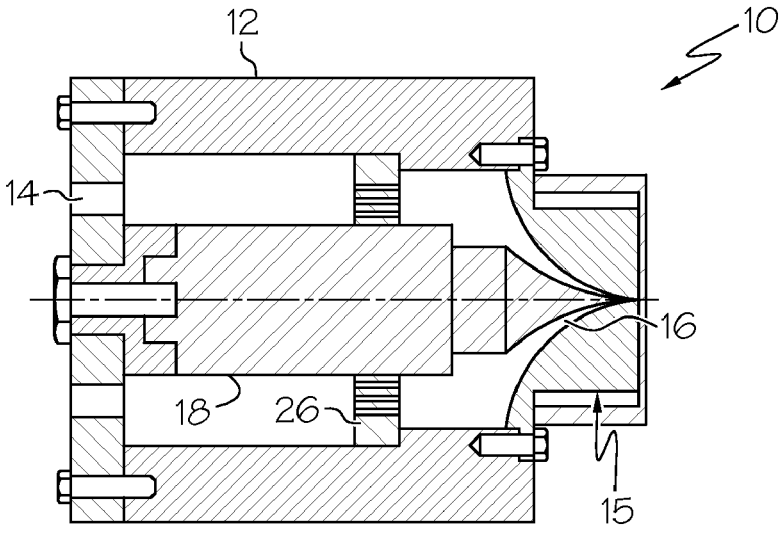
FIG. 1 depicts a cross-sectional view of a device for atomizing fluids according to one embodiment of the invention.

The embodiments set forth in the drawings are illustrative in nature and are not intended to be limiting of the invention defined by the claims. Moreover, individual features of the drawings and the invention will be more fully apparent and understood in view of the detailed description.

DETAILED DESCRIPTION

Cavitation effects inside nozzles have the ability to obtain a very fine droplet size distribution. However, current spray injector nozzles are not designed specifically to obtain controllable cavitation effects. In other words, previously, cavitation effects were not explicitly configured to impact droplet characteristics. According to one embodiment, a new combination of pressure modulation or velocity modulation on fluid jets, combined with cavitation effects, expedites the spray atomization process for high fluid flow rates leading to the generation of a fine droplet size distribution. Thus, one embodiment of the present invention relates to methods and apparatus to generate fine droplet size distribution with deeper spray penetration at high fluid flow rates by applying a novel concept of combining pressure modulation with cavitation effects which does not require high fluid pressure.

Figure 2A:
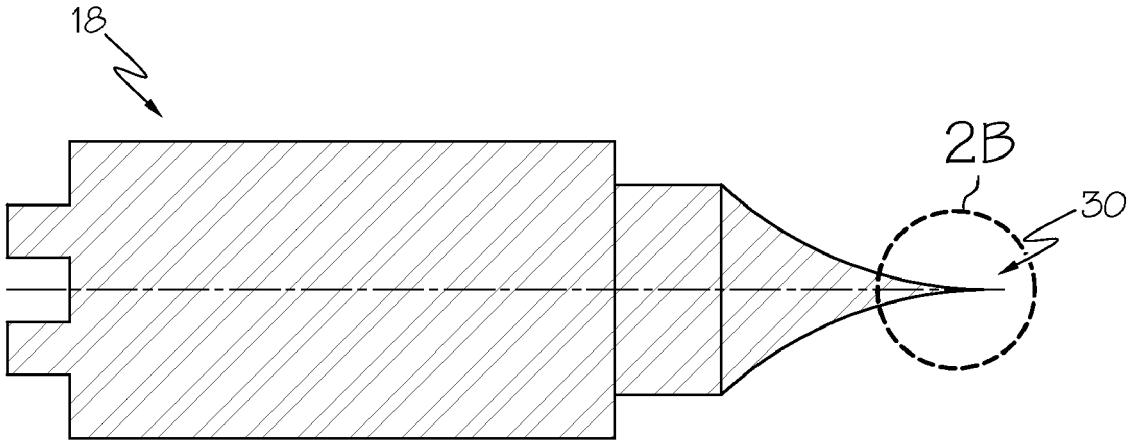
FIG. 2A depicts a schematic view of a transducer according to one embodiment of the invention.
Figure 2B:
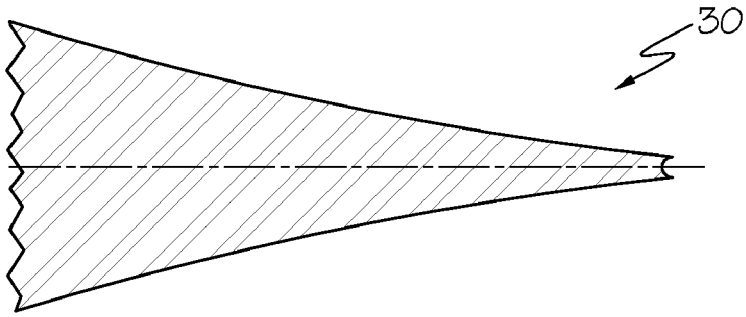
FIG. 2B depicts a magnified view of a tip of a transducer according to one embodiment of the invention.
Figure 3A:
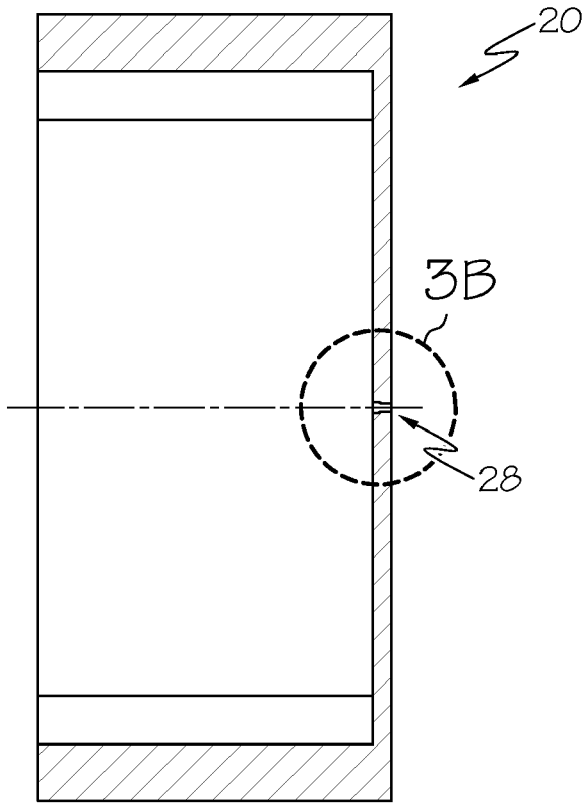
FIG. 3A depicts a cavitation enhancer module.
Figure 3B:
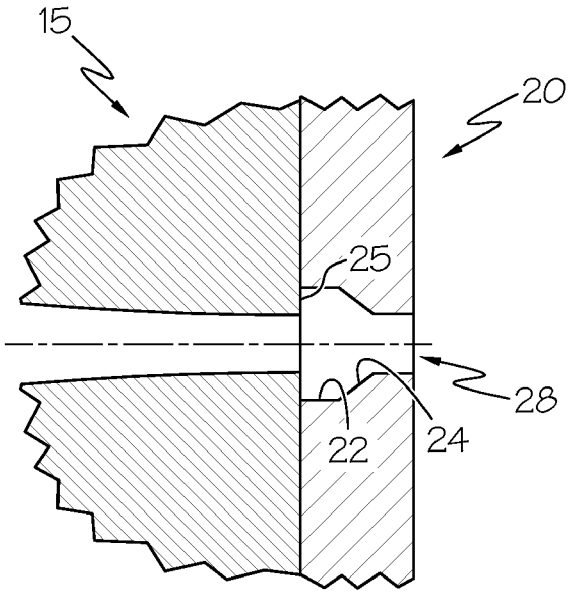
FIG. 3B depicts a close-up of a front end of the atomizing nozzle assembly including a portion of a cavitation enhancer module according to one embodiment of the invention.
Figure 4:
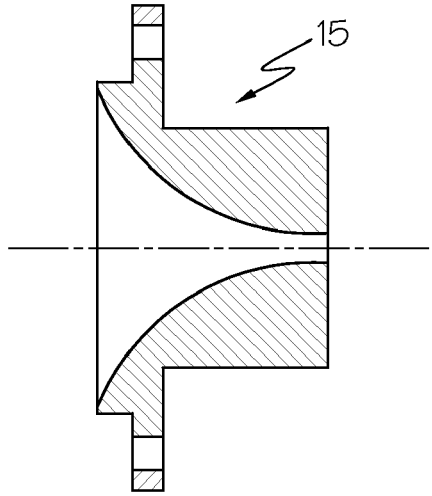
FIG. 4 depicts a close-up of a front end of the atomizing nozzle assembly.

FIGS. 1-3 show one embodiment of the present invention relating to devices and methods for atomizing a fluid. FIG. 1 depicts one embodiment of an apparatus for atomizing a fluid. This apparatus is made up of an atomizing nozzle assembly 10. The atomizing nozzle assembly 10 has a front end 15 (as also seen in FIG. 4) and includes a spray applicator enclosure 12 with a fluid entry zone 14. The fluid entry zone 14 can be of any shape and in one embodiment it is located at the rear of the nozzle assembly 10. The apparatus also includes a flow shape profiler region 16 located at the front end 15 of the atomizing nozzle assembly 10. In one embodiment, the flow shape profiler region 16 is configured to provide flow acceleration and in another embodiment it has a tapered profile. The flow shape profiler region 16 can have any shape which helps funnel fluid toward a fluid exit 28.

The apparatus also includes a transducer 18 in this embodiment. The transducer 18 imparts oscillation to the fluid. The transducer 18 can be at least partially located within the flow shape profiler region 16. In this embodiment, the transducer 18 can perform oscillatory motion in an axial fashion parallel to a nozzle axis. In this embodiment, the transducer 18 generates a horn motion and includes a tip 30, as seen in FIG. 2A. The tip 30 can be configured to maximize the pressure drop and activate cavitation nuclei. In one embodiment, the tip 30 is concave, as seen in FIG. 2B. In an additional embodiment, the transducer 18 is of a shape which is configured to adjust to local flow fields using an exponential profile. In one embodiment, the transducer 18 is a piezoelectric transducer. In a further embodiment, the apparatus includes at least one transducer supporting element 26.

The apparatus of this embodiment additionally includes a cavitation enhancer module 20. The cavitation enhancer module 20 can include a residence modulation zone 22 and the residence modulation zone 22 can include a backward facing step region 25. In one embodiment, the backward facing step region 25 is configured to create a shearing action. The backward facing step region can include either a single or multiple steps.

Additionally, in one embodiment, the apparatus also includes an exit 28. Moreover, in this embodiment, the apparatus is configured such that fluid can enter the fluid entry zone 14 to the flow shape profiler 16, the transducer 18, and the cavitation enhancer module 20. In this embodiment, the apparatus is further configured for high flow rate and/or low viscosity applications.

In another embodiment, the invention is directed to a method for atomizing a fluid. The method includes the acts of receiving pressurized fluid flow through a fluid entry zone in an atomizing apparatus. The apparatus includes a spray applicator enclosure having the fluid entry zone, a flow shape profiler region, a transducer, and a cavitation enhancer module. In one embodiment, the flow shape profiler region is tapered. In another embodiment, the transducer is of a shape configured to adjust to local flow fields using an exponential profile. The cavitation enhancer module includes a residence modulation zone, wherein the residence modulation zone includes a backward facing step region.

The method can further include the acts of allowing the fluid to flow axially towards the flow shape profiler region, performing oscillatory motion across the fluid in an axial fashion parallel to the nozzle axis, and shearing the fluid as it enters the backward facing step region of the residence modulation zone. In another embodiment, the method includes releasing the fluid from the atomizing apparatus.

In another embodiment, the invention is directed to another method for atomizing a fluid. This method includes the acts of receiving a pressurized fluid flow in an apparatus; accelerating the fluid through a nozzle in the apparatus; performing ultrasonic oscillation on the fluid in a direction parallel to the nozzle axis to create regions of low pressure down stream of the nozzle to cause pressure pulsation and modulate the flow with activated cavitation nuclei; imparting a shearing action on the modulated flow to enhance cavitation; creating a low pressure region to increase residence time for cavitation; impinging the fluid on a wall to increase static pressure and cause local cavitation collapse effect; and accelerating the collapsed cavitation flow toward and exit of the apparatus.

Thus, according to one embodiment of the present invention, the nozzle assembly 10 receives pressurized fluid flow through a rear fluid entry zone 14 which flows axially towards the flow shape profiler region 16 and across the transducer supporting element 26. The contracting flow shape profiler region 16 results in flow acceleration and the transducer 18, located at least partially within the flow shape profiler region 16, performs oscillatory motion in an axial fashion parallel to the nozzle axis. The oscillation of the transducer 18 at ultrasonic frequencies creates regions of low pressure in the downstream of the flow shape profiler region 16. The frontal surface of the transducer device 18 shown in FIG. 2(A) consists of a concave tip 30 surface, elaborated in FIG. 2(B), to maximize pressure drop and activate cavitation nuclei. Also, the shape of the transducer 18, shown in FIG. 2(B), is built using an exponential profile to adjust to the local flow field. With inherent pressure pulsation due to the oscillating horn motion and the accelerated flow field, as a result of flow area contraction, the fluid is now modulated with activated cavitation nuclei and a mixture of pure fluid with activated cavitation bubbles embedded within the flow is obtained downstream zone of the flow shape profiler region 16.

The modulated fluid enters the cavitation enhancer module 20. The cavitation enhancer module 20 consists of a residence modulation zone 22 which is built on a backward facing step profile 25 and attached to a tapered flow modulation zone 24. Due to the shearing action of the fluid jet, as it enters the backward facing step region 25, cavitation enhancement occurs. Further, the low pressure region in the immediate expansion vicinity of the inlet of the residence modulation zone 22, within the cavitation enhancement module 20, results in a low pressure region. The resulting low pressure zone increases residence time for cavitation bubble growth and for the diffusion processes. Further, the fluid now includes cavitation clusters and impinges on the walls of the residence modulation zone 22 resulting in an increase in the mixture of static pressure. This results in a local cavitation collapse effect.

The foregoing description of various embodiments and principles of the invention has been presented for the purposes of illustration and description. It is not intended to be exhaustive or to limit the inventions to the precise forms disclosed. Many alternatives, modifications, and variations will be apparent to those skilled the art. Moreover, although multiple inventive aspects and principles have been presented, these need not be utilized in combination, and various combinations of inventive aspects and principles are possible in light of the various embodiments provided above. Accordingly, the above description is intended to embrace all possible alternatives, modifications, aspects, combinations, principles, and variations that have been discussed or suggested herein, as well as all others that fall within the principles, spirit and scope of the inventions as defined by the claims.

What is claimed is:

1. An apparatus for atomizing a fluid, comprising an atomizing nozzle assembly, wherein the atomizing nozzle assembly comprises: a spray applicator enclosure having a fluid entry zone, a flow shape profiler region comprising a tapered profile to provide flow acceleration from said fluid entry zone to an outlet, a transducer having a portion located within the flow shape profiler region, and a cavitation enhancer module located adjacent to the outlet of the flow shape profiler region, wherein the cavitation enhancer module comprises a residence modulation zone and a tapered flow modulation zone fluidly coupled downstream of the residence modulation zone, wherein the residence modulation zone comprises a backward facing step region, wherein the apparatus is configured such that fluid can enter the fluid entry zone to the flow shape profiler region, and the cavitation enhancer module.

2. The apparatus of claim 1, wherein the transducer comprises a piezoelectric transducer.

3. The apparatus of claim 1, further configured for high flow rate and/or low viscosity applications.

4. The apparatus of claim 1, wherein the backward facing step region is configured to create a shearing action on the fluid.

5. The apparatus of claim 2, further comprising at least one piezoelectric transducer supporting element.

6. The apparatus of claim 2, wherein the piezoelectric transducer performs oscillatory motion on the fluid in an axial fashion parallel to a nozzle axis.

7. The apparatus of claim 2, wherein the piezoelectric transducer portion located within the flow shape profiler comprises a tip.

8. The apparatus of claim 7, wherein the tip is configured to maximize pressure drop and activate cavitation nuclei.

9. The apparatus of claim 8, wherein the tip is concave.

10. The apparatus of claim 1, wherein the transducer comprises a shape which is configured to adjust to local flow fields using an exponential profile.

11. The apparatus of claim 1, wherein the backward facing step region comprises a single step.

12. The apparatus of claim 1, wherein the backward facing region comprises multiple steps.

13. A method for atomizing a fluid, comprising receiving pressurized fluid flow through a fluid entry zone in an atomizing apparatus; wherein the atomizing apparatus comprises a spray applicator enclosure having the fluid entry zone, a flow shape profiler region, a transducer located within the flow shape profiler region, and a cavitation enhancer module, wherein the cavitation enhancer module comprises a residence modulation zone and a tapered flow modulation zone fluidly coupled downstream of the residence modulation zone, wherein the residence modulation zone comprises a backward facing step region; allowing the fluid to flow axially towards the flow shape profiler region; performing oscillatory motion across the fluid in an axial fashion parallel to the nozzle axis; and shearing the fluid as it enters the backward facing step region of the residence modulation zone and then the flow modulation zone.

14. The method of claim 13, further comprising releasing the fluid from the atomizing apparatus.

15. The method of claim 13, wherein the flow shape profiler region is tapered.

16. The method of claim 13, wherein the transducer comprises a piezoelectric transducer.

17. The method of claim 16, wherein the piezoelectric transducer comprises a shape which is configured to adjust to local flow fields using an exponential profile.

18. A method for atomizing a fluid, comprising:

a) receiving a pressurized fluid flow in an apparatus;

b) accelerating the fluid through a nozzle in the apparatus;

c) performing ultrasonic oscillation on the fluid in a direction parallel to the nozzle axis to create regions of low pressure down stream of the nozzle to cause pressure pulsation and modulate the flow with activated cavitation nuclei;

d) imparting a shearing action on the modulated flow to enhance cavitation using a cavitation enhancer module, wherein the cavitation enhancer module comprises a residence modulation zone and a tapered flow modulation zone fluidly coupled downstream of the residence modulation zone, wherein the residence modulation zone comprises a backward facing step region;

e) creating a low pressure region to increase residence time for cavitation;

f) impinging the fluid on a wall to increase static pressure and cause local cavitation collapse effect; and g) accelerating the collapsed cavitation flow toward an exit of the apparatus.

* * * * *